US005922229A

United States Patent [19]

Kurano

[11] Patent Number: 5,922,229

[45] **Date of Patent: *Jul. 13, 1999**

[54] GLOW PLUG WITH ION SENSING ELECTRODE

[75] Inventor: Atsushi Kurano, Kuwana, Japan

[73] Assignee: Denso Corporation, Kariya, Japan

[ * ] Notice: This patent is subject to a terminal disclaimer.

[21] Appl. No.: 08/917,848

[22] Filed: Aug. 27, 1997

[30] Foreign Application Priority Data

Sep. 12, 1996 [JP] Japan ..... 8-265542

[51] Int. Cl.[6] ..... F23Q 7/00

[52] U.S. Cl. ..... 219/270; 123/145 A; 123/145 R

[58] Field of Search ..... 219/270, 267, 219/544; 123/145 A, 145 R; 361/264–266

[56] References Cited

U.S. PATENT DOCUMENTS 4,739,731 4/1988 Habich et al. .

FOREIGN PATENT DOCUMENTS 456245 11/1991 European Pat. Off. .
3706555 1/1988 Germany .
3904022 8/1989 Germany .
7-259597 10/1995 Japan .

*Primary Examiner*—Teresa Walberg
*Assistant Examiner*—Shawntina T. Fuqua
*Attorney, Agent, or Firm*—Pillsbury Madison & Sutro LLP

[57] ABSTRACT

A glow plug includes a housing. A main body is at least partially disposed in the housing. The main body is supported with respect to the housing. A support member is included in the main body. A heating member is provided in the support member. A pair of lead wires are electrically connected to two ends of the heating member respectively. The lead wires extend out of the support member. An ion sensing electrode provided in the support member is operative for detecting a condition of ionization in a flame. The ion sensing electrode is buried in the support member to be prevented from being exposed to the flame.

5 Claims, 9 Drawing Sheets

GLOW PLUG WITH ION SENSING ELECTRODE

BACKGROUND OF THE INVENTION

1. Field of the Invention

This invention relates to a glow plug for facilitating the ignition and the burning of an air-fuel mixture, and also a glow plug for an internal combustion engine.

2. Description of the Related Art

In recent years, more effective emission control has been demanded in spark-ignition internal combustion engines and diesel engines for the protection of environment. To meet such a demand, various proposals have been made. Examples of the proposals are listed below. A first proposal relates to an improvement of the structure of an engine. A second proposal relates to after-treatment or post-treatment using a catalytic converter. A third proposal relates to an improvement of the properties of fuel or lubricant. A fourth proposal relates to an improvement of a burning control system for an engine.

A recent burning control system for an engine requires the detection of conditions of the burning of an air-fuel mixture in a combustion chamber of the engine. According to proposals, the pressure in a combustion chamber, the light generated by the burning of an air-fuel mixture, the ion current related to the combustion chamber, and other physical parameters are detected as an indication of conditions of the burning of the air-fuel mixture.

The detection of burning conditions in response to an ion current means a direct observation of a chemical reaction caused during the burning of an air-fuel mixture. Accordingly, it is thought that the ion-current-based detection is useful. Various methods of detecting an ion current have been proposed.

Japanese published unexamined patent application 7-259597 discloses a sensor for detecting the degree of ionization of gases in an engine combustion chamber. In Japanese application 7-259597, the sensor has a measurement sleeve electrode which is provided concentrically around a fuel injection nozzle extending into the engine combustion chamber from a cylinder head. The measurement sleeve electrode is insulated from walls of the fuel injection nozzle and walls of the cylinder head.

U.S. Pat. No. 4,739,731 discloses a ceramic glow plug designed to detect an ion current caused during the burning of an air-fuel mixture in an engine combustion chamber. In U.S. Pat. No. 4,739,731, the ceramic glow plug extends into the engine combustion chamber. A tip of the ceramic glow plug has an electrically conductive layer made of platinum. The ceramic glow plug contains an electrical conductor leading from the electrically conductive tip thereof. A direct voltage of 250 V is applied between the electrically conductive tip of the ceramic glow plug and the wall of the combustion chamber.

The sensor in Japanese application 7-259597 has the following problems. It is necessary to insulate the measurement sleeve electrode of the sensor from the walls of the fuel injection nozzle and the walls of the cylinder head. Therefore, laborious steps are required in making and locating the sensor. The measurement sleeve electrode of the sensor is expensive. As the related engine is used for a long term, carbon collects in a space between the measurement sleeve electrode and the walls of the fuel injection nozzle and a space between the measurement sleeve electrode and the walls of the cylinder head. In some cases, the measurement sleeve electrode is short-circuited to the walls of the fuel injection nozzle or the walls of the cylinder head by the collected carbon.

The ceramic glow plug of U.S. Pat. No. 4,739,731 has the following problem. A large amount of platinum is used in making the ceramic glow plug. Therefore, the ceramic glow plug is expensive.

SUMMARY OF THE INVENTION

It is an object of this invention to provide an improved glow plug which can solve the previously-indicated problems in the prior art.

A first aspect of this invention provides a glow plug comprising a housing; a main body at least partially disposed in the housing and supported with respect to the housing; a support member included in the main body; a heating member provided in the support member; a pair of lead wires electrically connected to two ends of the heating member respectively and extending out of the support member; and an ion sensing electrode provided in the support member for detecting a condition of ionization in a flame; wherein the ion sensing electrode is buried in the support member to be prevented from being exposed to the flame.

A second aspect of this invention is based on the first aspect thereof, and provides a glow plug wherein an insulation resistance of a region of the support member between an outer surface of the support member and the ion sensing electrode is equal to 50 MΩ or less at a temperature of 300° C.

A third aspect of this invention is based on the first aspect thereof, and provides a glow plug wherein the support member is made from a mixture of insulating ceramic, electrically conductive ceramic, and a sintering assistant, wherein the insulating ceramic includes silicon nitride, wherein the electrically conductive ceramic includes at least one of metal nitride, metal boride, metal carbide, and metal silicide, and wherein the sintering assistant includes aluminum oxide and at least one of rare-earth element oxides.

A fourth aspect of this invention is based on the first aspect thereof, and provides a glow plug wherein the heating member and the ion sensing electrode are formed by a single member.

A fifth aspect of this invention provides a glow plug comprising a support member; a heating member provided in the support member; and an electrode for sensing an ion current, the electrode having a sensing portion which is buried in the support member to be protected by the support member.

DESCRIPTION OF THE PREFERRED EMBODIMENTS

Basic Embodiment

Figure 1:
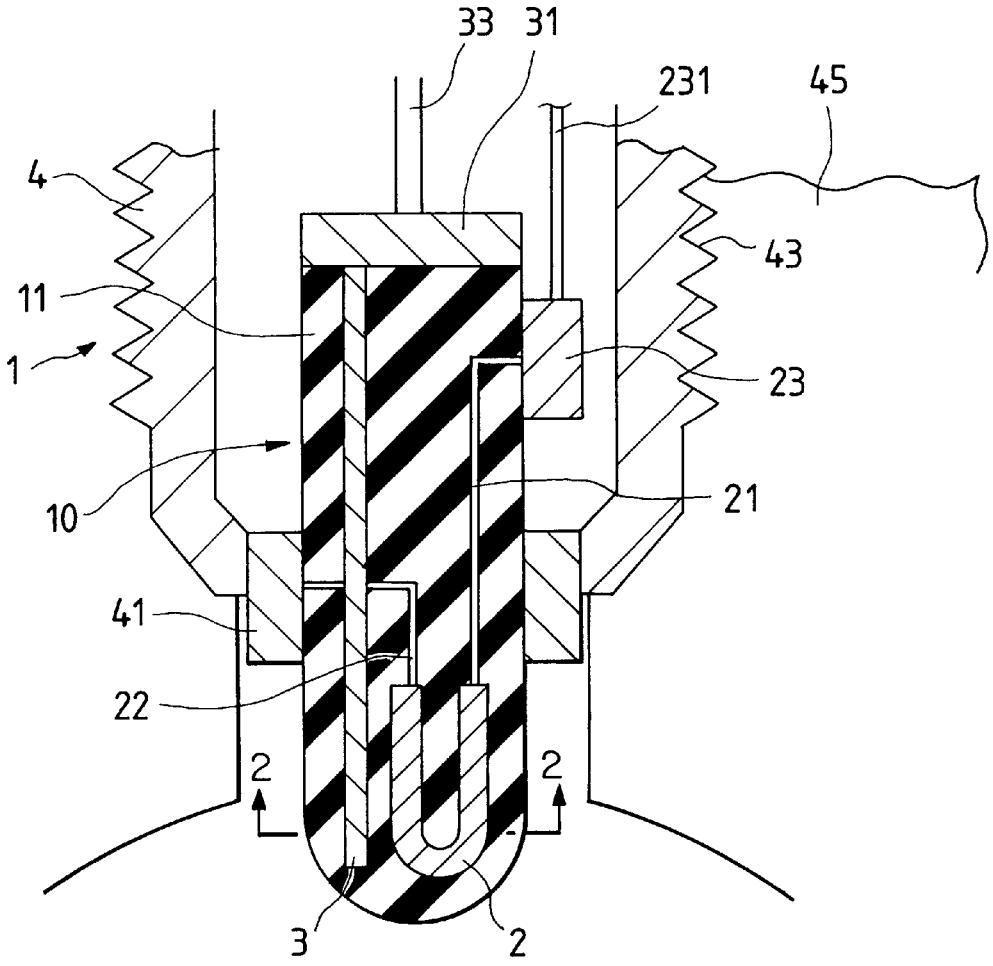
FIG. 1 is a sectional view of a portion of a glow plug according to a first specific embodiment of this invention.

According to a basic embodiment of this invention, a glow plug comprises a housing; a main body at least partially disposed in the housing and supported with respect to the housing; a support member included in the main body; a heating member provided in the support member; a pair of lead wires electrically connected to two ends of the heating member respectively and extending out of the support member; and an ion sensing electrode provided in the support member for detecting a condition of ionization in a flame; wherein the ion sensing electrode is buried in the support member to be prevented from being exposed to the flame.

The glow plug according to the basic embodiment of this invention features that the ion sensing electrode is buried in the support member to be prevented from being exposed to the flame.

To maintain an ion sensing function, the support member has an electrical conductivity during the detection of an ion current. For example, the support member uses ceramic having an electrical conductivity.

The heating member is heated when an electric current flows therethrough. The ion sensing electrode is an electrode for sensing an ion current. The heating member and the ion sensing electrode are provided as separate members. Alternatively, the heating member and the ion sensing electrode may be formed by a single member having both a heating function and an ion sensing function.

Molded members forming the heating member and the ion sensing electrode are previously made. Then, the molded members are placed in powder for the support member. Subsequently, the molded members and the powder are combined into a single lump.

Alternatively, halves of the support member are previously made. In this case, the heating member and the ion sensing electrode are placed between the halves of the support member.

A lump of the heating member, the ion sensing electrode, and the powder for the support member is made by subjecting their material powders to injection molding.

The heating member and the ion sensing electrode may be formed in the support member by a printing process.

An example of the printing process is as follows. A green sheet for the support member is prepared. The green sheet is made of ceramic material. The heating member, the lead wires, and the ion sensing electrode having desired shapes are provided on a surface of the green sheet by screen printing, pad printing, or hot stamping. The heating member, the lead wires, and the ion sensing electrode are made of electrically conductive materials. The resultant sheet is made into a roll. The roll is fired or sintered. As a result, the support member is completed which contains the heating member, the lead wires, and the ion sensing electrode formed by the printing process.

In the glow plug according to the basic embodiment of this invention, the heating member is heated when being supplied with an electric current. This heating process aids the ignition and the burning of an air-fuel mixture in a combustion chamber.

The ion sensing electrode serves to sense a condition of ionization in a flame. During the detection of an ion current, the ion sensing electrode buried in the support member and the inner walls (cylinder head walls) of the combustion chamber close thereto form two opposite electrodes for capturing positive and negative ions present in a region between the two opposite electrodes.

Thereby, it is possible to accurately detect the ion current. Information of the ion current can be used in the control of the burning of the air-fuel mixture. The glow plug is provided with both the function of heating air in the combustion chamber and the function of detecting an ion current. Therefore, the glow plug is compact in structure, and is low in price.

In the glow plug according to the basic embodiment of this invention, the ion sensing electrode is buried in the support member to be prevented from being exposed to the flame. Thus, it is possible to prevent the ion sensing electrode from being corroded by the flame. The resistance of the ion sensing electrode is prevented from changing. Accordingly, it is possible to accurately detect an ion current for a long term.

Furthermore, it is possible to prevent the ion sensing electrode from being damaged by thermal shock in the combustion chamber.

As previously explained, according to the basic embodiment of this invention, it is possible to prevent the ion sensing electrode from being corroded and damaged. Thus, it is unnecessary to use expensive metal such as platinum. Accordingly, the glow plug is low in price.

Carbon caused by the burning of an air-fuel mixture sometimes adheres to a surface of the support member. The heating process implemented by the heating member burns the carbon away from the support member. Therefore, it is possible to accurately detect an ion current for a long term.

In the glow plug according to the basic embodiment of this invention, the heating member, the lead wires, and the ion sensing electrode are provided in the support member. Thus, the glow plug has a simple structure.

In the glow plug according to the basic embodiment of this invention, carbon adhering to the surface of the support member is prevented from causing a problem. It is possible to accurately detect an ion current. The glow plug is durable.

It is preferable that an insulation resistance of a region of the support member between an outer surface of the support member and the ion sensing electrode is equal to 50 MΩ or less at a temperature of 300° C. In the case where the insulation resistance exceeds 50 MΩ at a temperature of 300° C., the sensed level of an ion current is too small. Thus, in this case, it tends to be difficult to accurately detect an ion current. To maintain sufficient insulation during the supply of an electric current to the heating member, it is preferable that the insulation resistance is equal to 10 kΩ or greater. A temperature of 300° C. is used in consideration of the fact that the support member receives a temperature rise when the glow plug is in a normal position relative to the combustion chamber.

It is preferable that the support member is made from a mixture of insulating ceramic, electrically conductive ceramic, and a sintering assistant, that the insulating ceramic includes silicon nitride, that the electrically conductive ceramic includes at least one of metal nitride, metal boride, metal carbide, and metal silicide, and that the sintering assistant includes aluminum oxide and at least one of rare-earth element oxides. Thus, the electrically conductive ceramic having a low insulation resistance is mixed with the insulating ceramic having a high insulation resistance to provide a given electrical conductivity. Thereby, the insulation resistance of the support member can be in the previously-indicated preferable range.

Examples of the metal nitride, the metal boride, the metal carbide, and the metal silicide mixed with the insulating ceramic (silicon nitride, $Si_3N_4$) are as follows. The metal nitride uses at least one of TiN, ZrN, VN, NbN, TaN, and $Cr_2N$. The metal boride uses at least one of $TiB_2$, $ZrB_2$, $HfB_2$, $VB_2$, $NbB_2$, $TaB_2$, CrB, $CrB_2$, $Mo_2B$, $Mo_2B_5$, WB, $W_2B_5$, and $LaB_6$. The metal carbide uses at least one of TiC, ZrC, VC, NbC, TaC, $Cr_3C_2$, $Mo_2C$, $W_2C$, and WC. The metal silicide uses at least one of $TiSi_2$, $ZrSi_2$, $NbSi_2$, $TaSi_2$, $CrSi_2$, $Mo_5Si_3$, $MoSi_2$, and $WSi_2$.

As previously explained, the electrically conductive ceramic is mixed with the insulating ceramic (silicon nitride, $Si_3N_4$). The weight ratio of the electrically conductive ceramic to the resultant mixture is preferably in the range of 5% to 50%. When the weight ratio is smaller than 5%, it tends to be difficult to provide a sufficiently low insulation resistance. In the case where the weight ratio exceeds 50%, the strength of the support member tends to be low at high temperatures. In this case, the support member tends to be damaged by thermal shock.

The rare-earth element oxide in the sintering assistant uses $Y_2O_3$, $Yb_2O_3$, $Nd_2O_3$, or $Sc_2O_3$.

The heating member and the ion sensing electrode may be formed by a single member. Thus, the single member is provided with both the function of the heating member and the function of the ion sensing electrode. In this case, the glow plug can be simpler in structure. The single member has a large effective area related to an ion sensing process. The large effective area results in a high accuracy of detection of an ion current.

First Specific Embodiment

Figure 2:
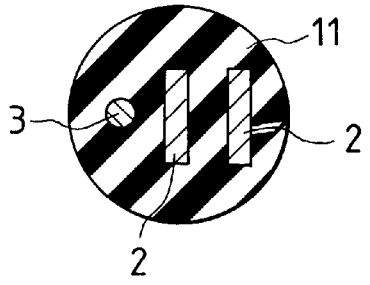
FIG. 2 is a sectional view taken along the line A—A in FIG. 1.

FIGS. 1 and 2 show a glow plug 1 used for preheating air in an engine combustion chamber and aiding a related engine in starting. The glow plug 1 is designed to detect an ion current caused during the burning of an air-fuel mixture in the engine combustion chamber.

With reference to FIGS. 1 and 2, the glow plug 1 includes a housing 4 and a main body 10. The main body 10 is supported with respect to the housing 4. Specifically, the main body 10 is fixed to a lower end of the housing 4 via a ring member 41 made of metal. The ring member 41 may be a part of the housing 4. An upper portion of the main body 10 is located within the housing 4. A lower portion of the main body 10 extends from the housing 4 into the engine combustion chamber.

The main body 10 includes a support member 11, a heating member 2, and a pair of lead wires 21 and 22. The heating member 2 is heated when an electric current flows therethrough. The heating member 2 is provided within the support member 11. Specifically, the heating member 2 is buried in the support member 11. The lead wires 21 and 22 extend in the support member 11. A first end of the lead wire 21 is electrically connected to a first end of the heating member 2. A second end of the lead wire 21 reaches a side surface of the support member 11. A first end of the lead wire 22 is electrically connected to a second end of the heating member 2. A second end of the lead wire 22 reaches a side surface of the support member 11.

The main body 10 also includes an ion sensing electrode 3. The ion sensing electrode 3 is used in detecting the conditions of ionization of a flame in the engine combustion chamber, for example, the degree of ionization of a flame in the engine combustion chamber. A major sensing part of the ion sensing electrode 3 is buried in the support member 11. Thus, it is possible to prevent the ion sensing electrode 3 from being exposed to a flame in the engine combustion chamber.

Preferably, the support member 11 is made of ceramic containing $Si_3N_4$ (silicon nitride) and $TiB_2$ (titanium boride).

In the support member 11, the lead wire 21 extends upward from the first end of the heating member 2. The lead wire 21 reaches an electrically conductive terminal 23 provided on the side surface of the main body 10. The lead wire 21 is electrically connected to a lead wire 231 via the terminal 23. In the support member 11, the lead wire 22 extends from the second end of the heating member 2. The lead wire 22 reaches the ring member 41. The lead wire 22 is electrically connected to the walls of the housing 4 via the ring member 41. It should be noted that the ring member 41 is made of metal. Thus, the second end of the heating member 2 is electrically connected to the walls of the housing 4 via the lead wire 22 and the ring member 41.

An upper portion of the ion sensing electrode 3 reaches an electrically conductive terminal 31 provided on a top end of the support member 11. The ion sensing electrode 3 is electrically connected to a lead wire 33 via the terminal 31.

Figure 3:
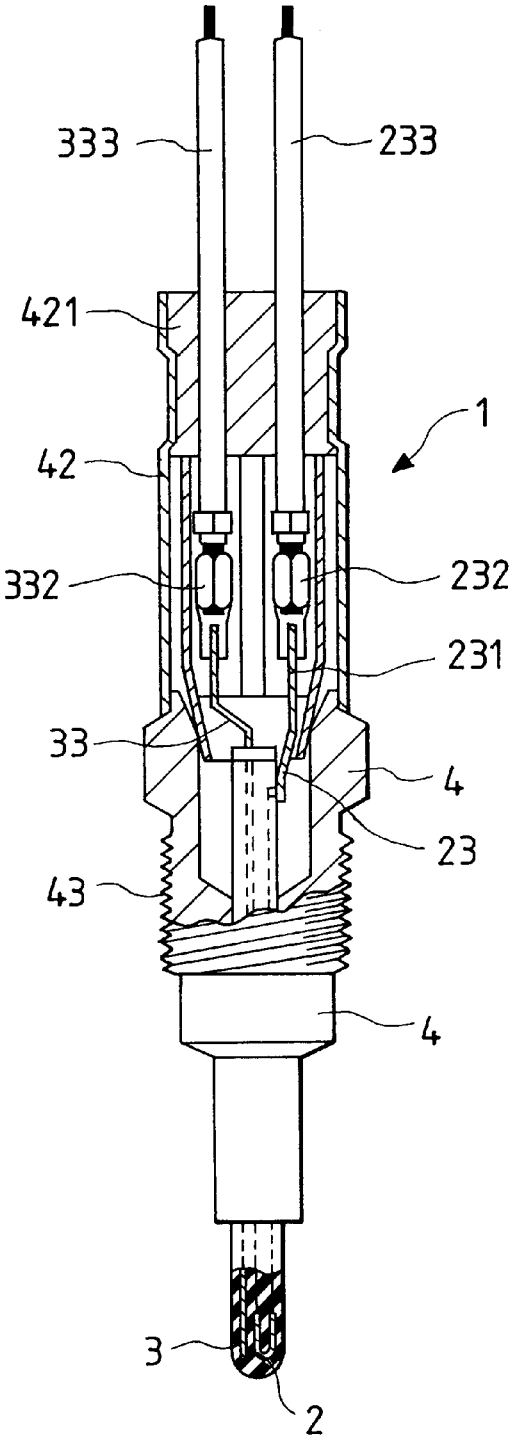
FIG. 3 is a view, partially in cross section, of the glow plug according to the first specific embodiment of this invention.

As shown in FIG. 3, an upper portion of the housing 4 includes a protective tube 42. Outer surfaces of the housing 4 have threads 43 forming a male screw in engagement with female threads in walls of an engine cylinder head 45 (see FIG. 1). Thereby, the housing 4 is fixed to the cylinder head 45. A rubber bush 421 fits into an upper opening of the protective tube 42. Lead wires 233 and 333 extend through the rubber bush 421. The lead wires 233 and 333 are electrically connected to the lead wires 231 and 33 via terminals 232 and 332, respectively. Accordingly, the lead wire 233 is electrically connected to the first end of the heating member 2 while the lead wire 333 is electrically connected to the ion sensing electrode 3.

As previously explained, the second end of the heating member 2 is electrically connected to the walls of the housing 4 via the lead wire 22 and the ring member 41. The tip of the main body 10, that is, the lower end of the main body 10 (the lower end of the support member 11), is hemispherical. The heating member 2 is buried in the support member 11. As previously explained, the major part of the ion sensing electrode 3 is buried in the support member 11.

Figure 4:
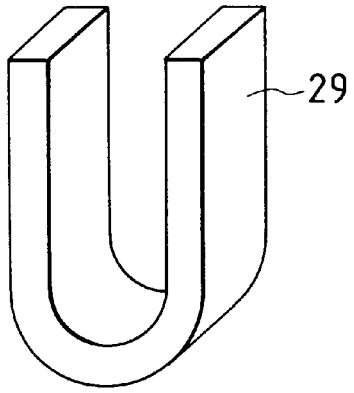
FIG. 4 is a perspective view of a molded member which will form a heating member in FIG. 1.
Figure 5:
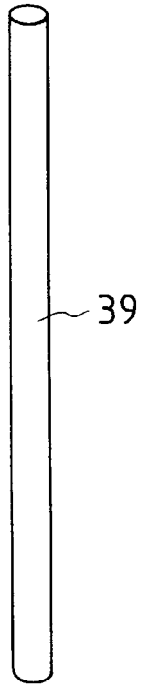
FIG. 5 is a perspective view of a molded bar which will form an ion sensing electrode in FIG. 1.

The main body 10 of the glow plug 1 was made as follows. As shown in FIG. 4, a U-shaped molded member 29 forming the heating member 2 was prepared. In addition, as shown in FIG. 5, a molded bar 39 forming the ion sensing electrode 3 was prepared. The U-shaped molded member 29 was made from ceramic powder by injection molding or press molding. Also, the molded bar 39 was made from ceramic powder by injection molding or press molding.

The lead wires 21 and 22 were connected to the U-shaped molded member 29. Subsequently, the U-shaped molded member 29 and the molded bar 39 were placed or buried into ceramic powder for the support member 11. The U-shaped molded member 29, the molded bar 39, and the ceramic powder for the support member 11 were fired or sintered by hot pressing, being made into a single unit. Then, the unit was ground into a shape of the support member 11. Thus, the main body 10 of the glow plug 1 was completed. The completed main body 10 contained the heating member 2 and the ion sensing electrode 3.

The details of the ceramic powder for the support member 11 are as follows. Main ingredients were prepared which had 95% $Si_3N_4$ and 5% $TiB_2$ by weight. The $Si_3N_4$ ingredient was insulating ceramic. The $TiB_2$ ingredient was electrically conductive ceramic. As sintering assistants, $Y_2O_3$ and $Al_2O_3$ were added to the main ingredients by 10 weight-%. In addition, a composite binder was added thereto by 15 weight-%. The composite binder contained paraffin wax as a main component. The main ingredients and the added materials were mixed into the ceramic powder for the support member 11.

It should be noted that regarding the sintering assistants, oxide of one type which contains rare-earth element or oxide of two or more types which contains rare-earth elements may be added, and grains of $Si_3N_4$ may be crystallized and be then used.

Figure 6:
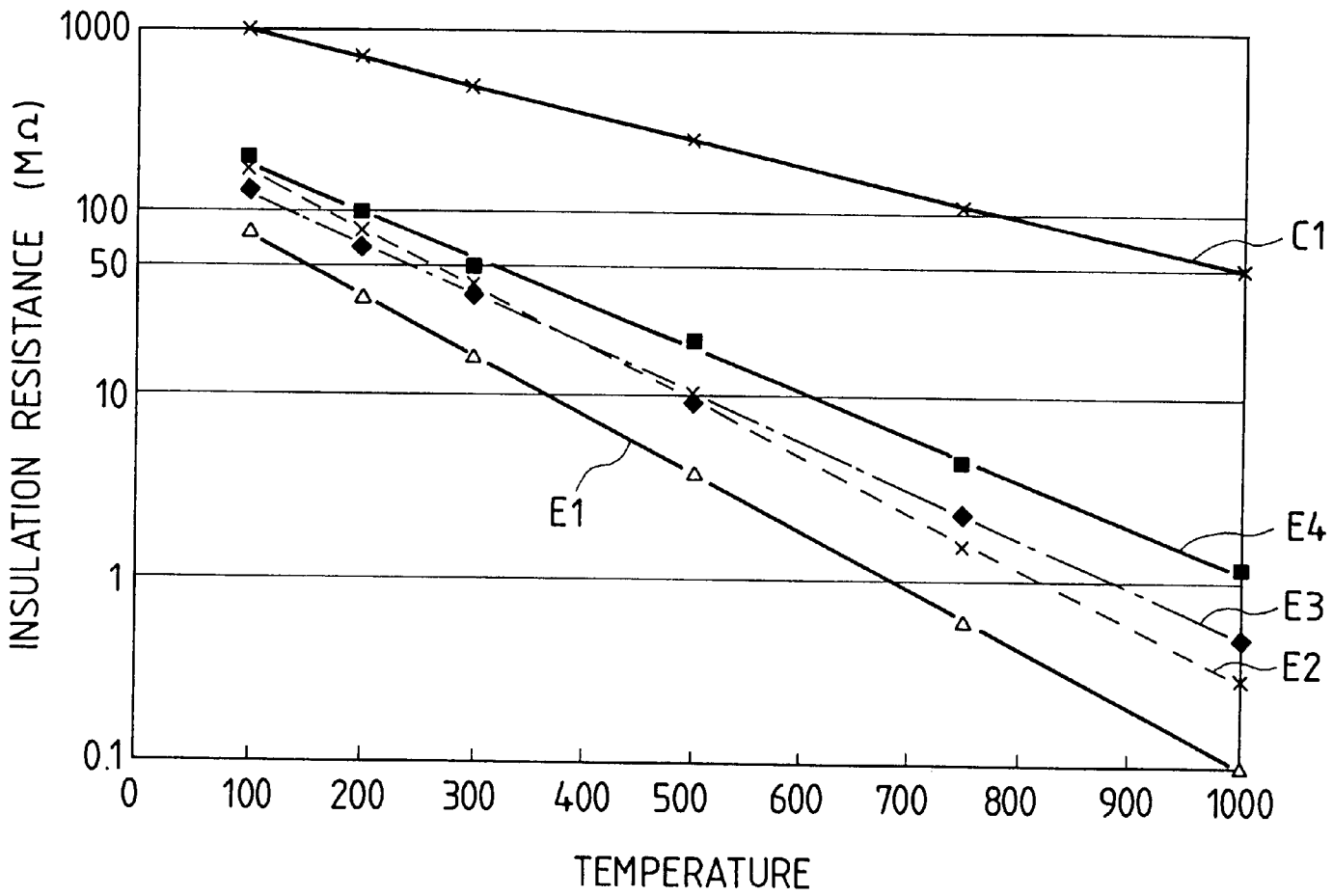
FIG. 6 is a diagram of the relations between the insulation resistances of samples of a support member and the ambient temperature.

Experiments were carried out. During the experiments, the ceramic powder for the support member 11 which contained molded members for the heating member 2 and the ion sensing electrode 3 was subjected to pressure sintering for 60 minutes. Conditions of the pressure sintering were as follows. The applied pressure was equal to 500 $kg/cm^2$. The sintering temperature (the firing temperature) was equal to 1,800° C. The insulation resistance of the region of the sintering-resultant thing between an outer surface thereof and the ion sensing electrode 3 was measured at varying temperatures. In FIG. 6, the line denoted by the character E1 represents the results of the measurement which correspond to the relation between the insulation resistance of the sintering-resultant thing and the ambient temperature. According to the line E1 of FIG. 6, the insulation resistance of the sintering-resultant thing is equal to about 20 MΩ or less at a temperature of 300° C. Thus, the sintering-resultant thing has a conductivity sufficient to conduct an ion current.

Figure 7:
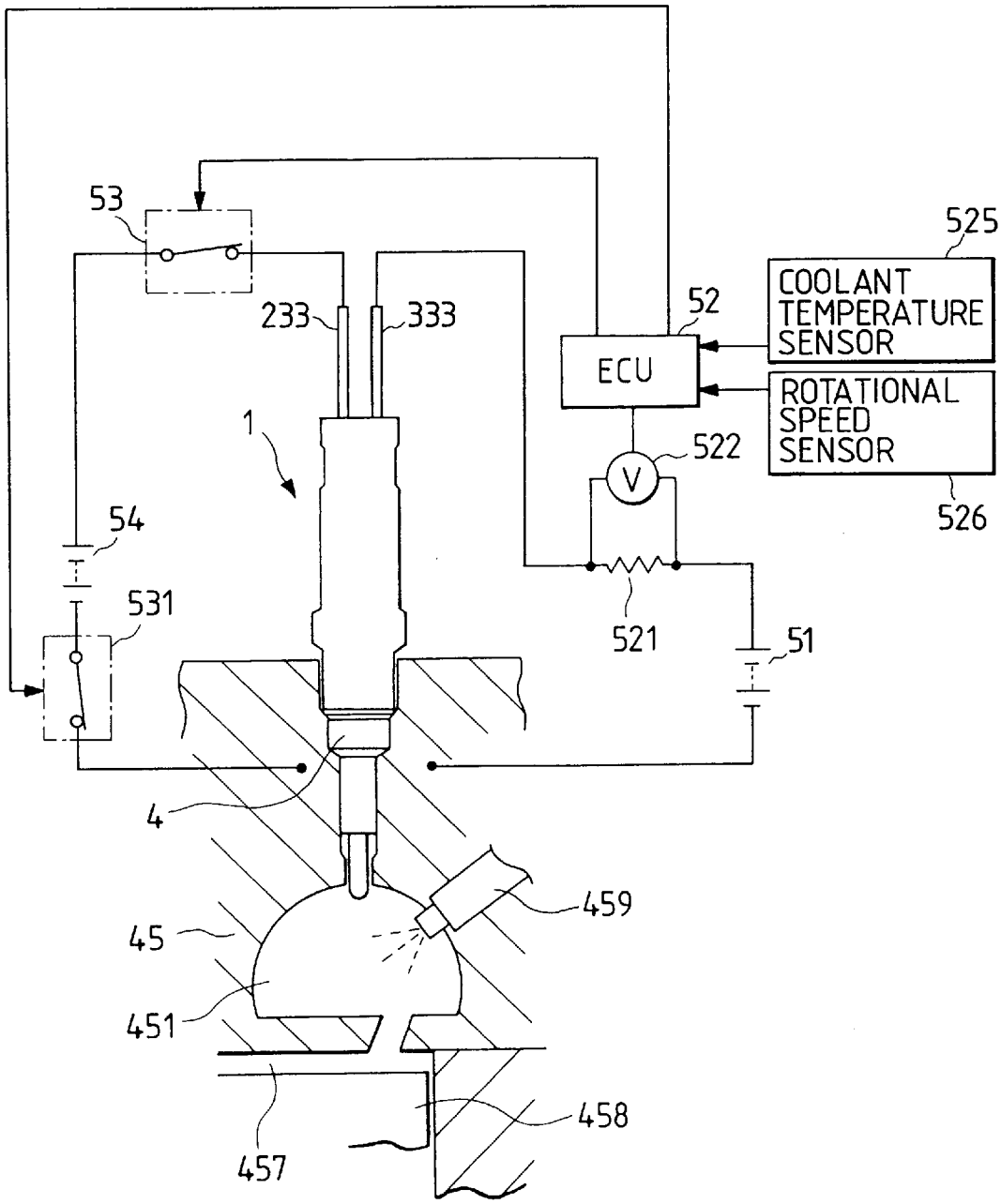
FIG. 7 is a diagram of the glow plug and a drive circuit for the glow plug according to the first specific embodiment of this invention.

As shown in FIG. 7, the glow plug 1 is attached to the cylinder head 45 by moving the male threads of the housing 4 into engagement with the female threads of the cylinder head 45. When the glow plug 1 is set in position relative to the cylinder head 45, the tip of the main body 10 of the glow plug 1 projects into a swirl chamber 451 which is a part of the engine combustion chamber. The swirl chamber 451 communicates with a main part 457 of the engine combustion chamber which is defined between a piston 458 and a lower surface of the cylinder head 45. A fuel injection nozzle 459 extends into the swirl chamber 451.

As previously explained, the lead wire 233 is electrically connected to the first end of the heating member 2. As shown in FIG. 7, the lead wire 233 is electrically connected to the positive terminal of a battery 54 via a relay 53. The battery 54 generates a voltage of, for example, 12 V. The negative terminal of the battery 54 is electrically connected to the cylinder head 45 via a relay 531. It should be noted that the cylinder head 45 is made of metal. As previously explained, the second end of the heating member 2 is electrically connected to the walls of the housing 4 via the lead wire 22 and the ring member 41. The housing 4 and the cylinder head 45 are electrically connected to each other. Accordingly, the first end of the heating member 2 is electrically connected to the second end thereof via the lead wire 233, the relay 53, the battery 54, the relay 531, the cylinder head 45, the housing 4, the ring member 41, and the lead wire 22. In this way, there is provided a drive circuit for the heating member 2 which includes the battery 54.

As previously explained, the lead wire 333 is electrically connected to the ion sensing electrode 3. As shown in FIG. 7, the lead wire 333 is electrically connected to the positive terminal of a dc power supply 51 via a fixed resistor 521 used for sensing an ion current. The dc power supply 51 generates a voltage of, for example, 500 V. The resistance of the fixed resistor 521 is equal to, for example, about 500 kΩ. The negative terminal of the dc power supply 51 is electrically connected to the cylinder head 45. A potentiometer 522 is electrically connected across the fixed resistor 521 to measure an ion current. The potentiometer 522 is electrically connected to an electronic control unit (ECU) 52. Control terminals of the relays 53 and 531 are electrically connected to the ECU 52. An engine coolant temperature sensor 525 and a rotational engine speed sensor 526 are electrically connected to the ECU 52.

The ECU 52 includes a microcomputer or a similar device which has a combination of an input/output port, a CPU, a ROM, and a RAM. The ECU 52 operates in accordance with a program stored in the ROM.

The ECU 52 is programmed to implement the following process. During a start of the engine, the ECU 52 moves the relays 53 and 531 to their on positions. As a result, the electrical connection between the battery 54 and the heating member 2 of the glow plug 1 is established, and an electric current generated by the battery 54 flows through the heating member 2. Thus, the heating member 2 is activated by the electric current. The heating member 2 is heated by the electric current so that the glow plug 1 is also heated. Air in the swirl chamber 451 is heated by the glow plug 1. Accordingly, a preheating process is executed. When the preheating process is completed, the temperature of air in the swirl chamber 451 reaches a level at which an air-fuel mixture can spontaneously ignite. After the preheating process is completed, fuel is injected into the swirl chamber 451 via the fuel injection nozzle 459. The injected fuel and the air form a mixture which ignites. Thus, the burning of the air-fuel mixture starts. The burning of the air-fuel mixture progresses while the related flame is propagated from the swirl chamber 451 to the main part 457 of the engine combustion chamber. Thereby, a high pressure and a high temperature occur in the main part 457 of the engine combustion chamber, moving the piston 458 downward. As a result, the engine is started.

Ions are generated during the burning of the air-fuel mixture. The generated ions cause an electric current, that is, an ion current, with the aid of the dc power supply 51. The ion current flows along a closed-loop path containing the swirl chamber 451, the walls of the support member 11, the ion sensing electrode 3, the lead wire 333, the fixed resistor 521, the dc power supply 51, and the cylinder head 45. A voltage across the fixed resistor 521 is proportional to the ion current. The potentiometer 522 detects the voltage across the fixed resistor 521, and outputs a signal representative of the ion current to the ECU 52.

Specifically, the dc power supply 51 applies a voltage of 500 V between the ion sensing electrode 3 of the glow plug 1 and the cylinder head 45. As previously explained, the support member 11 which covers the ion sensing electrode 3 has a conductivity sufficient to conduct an ion current. Ions generated in the flame in the swirl chamber 451 cause an ion current with the aid of the dc power supply 51. The ion current flows along a closed-loop path containing the fixed resistor 521. As previously indicated, the resistance of the fixed resistor 521 is equal to, for example, about 500 kΩ. A voltage proportional to the ion current is developed across the fixed resistor 521. The potentiometer 522 detects the voltage across the fixed resistor 521, and outputs a signal representative of the ion current to the ECU 52.

A detailed explanation will be given of the detection of the ion current. Fuel is injected into the swirl chamber 451 via the fuel injection nozzle 459. The injected fuel and the air forms a mixture. The air-fuel mixture spontaneously ignites and then burns. A large number of positive ions and negative ions is generated in the flame of the burning. Since the dc power supply 51 applies a voltage between the ion sensing electrode 3 and the cylinder head 45, negative ions are attracted and captured by the ion sensing electrode 3 through the walls of the support member 11 while positive ions are attracted and captured by the walls of the cylinder head 45. Thus, an ion current flows along a closed-loop path containing the fixed resistor 521. A voltage proportional to the ion current is developed across the fixed resistor 521. The potentiometer 522 detects the voltage across the fixed resistor 521, and outputs a signal representative of the ion current to the ECU 52.

The ECU 52 derives information of the ion current from the output signal of the potentiometer 522. The ECU 52 receives an output signal of the engine coolant temperature sensor 525. The ECU 52 derives information of the temperature Tw of engine coolant from the output signal of the engine coolant temperature sensor 525. The ECU 52 receives an output signal of the rotational engine speed sensor 526. The ECU 52 derives information of the rotational engine speed Ne from the output signal of the rotational engine speed sensor 526.

In the case where the engine is required to start when the temperature of the engine is relatively low, the ECU 52 controls the relays 53 and 531 to activate the heating member 2 of the glow plug 1. The activation of the heating member 2 implements a preheating process, thereby aiding the ignition and the burning of an air-fuel mixture. The ECU 52 monitors the ion current during a start of the engine, during a time interval immediately after the start of the engine, and during normal operation of the engine. At an initial stage of the start of the engine, the ECU 52 sets the relays 53 and 531 to their on positions so that the heating member 2 remains activated.

Figure 8:
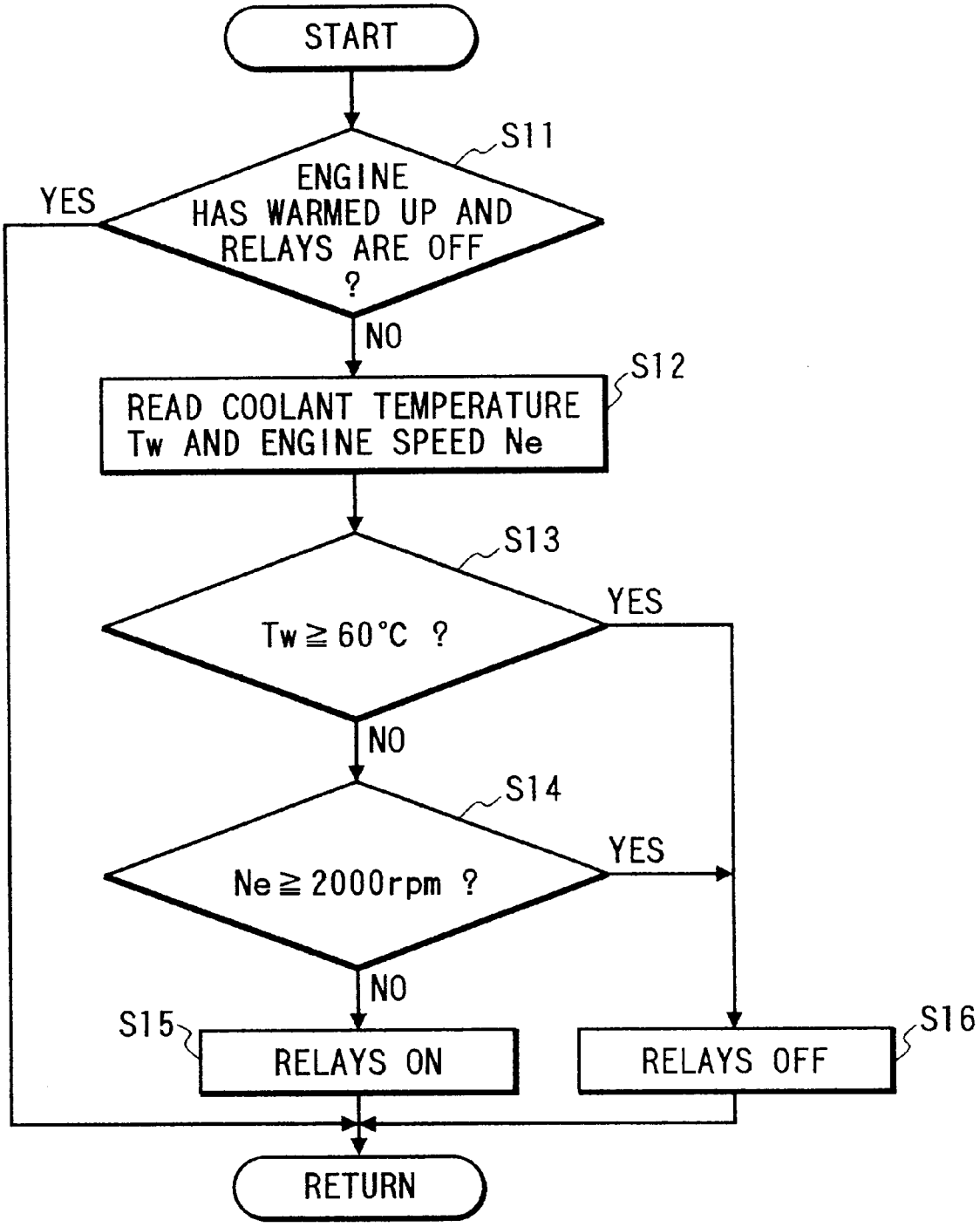
FIG. 8 is a flowchart of a segment of a program related to operation of an electronic control unit (ECU) in FIG. 7.

FIG. 8 is a flowchart of a segment (a sub routine) of the program related to operation of the ECU 52. The program segment in FIG. 8 is iteratively executed at a predetermined period in the case where the engine is required to start. The iterative execution of the program segment is implemented by a timer-based interruption process.

As shown in FIG. 8, a first step S11 of the program segment decides whether or not the engine has warmed up and the relays 53 and 531 are in their off positions. In the case where the engine has warmed up and the relays 53 and 531 are in their off positions, the program exits from the step S11 and the current execution cycle of the program segment ends before the program returns to a main routine. Otherwise, the program advances from the step S11 to a step S12.

The step S12 derives the current coolant temperature Tw from the output signal of the engine coolant temperature sensor 525. The step S12 derives the current rotational engine speed Ne from the output signal of the rotational engine speed sensor 526.

A step S13 following the step S12 compares the current coolant temperature Tw with a predetermined reference temperature to decide whether or not the engine has warmed up. The predetermined reference temperature is equal to, for example, 60° C. When the current coolant temperature Tw is equal to or higher than the predetermined reference temperature (60° C.), that is, when the engine has warmed up, the program advances from the step S13 to a step S16. Otherwise, the program advances from the step S13 to a step S14.

The step S14 compares the current rotational engine speed Ne with a predetermined reference speed equal to, for example, 2,000 rpm. When the current rotational engine speed Ne is equal to or higher than the predetermined reference speed (2,000 rpm), the program advances from the step S14 to the step S16. Otherwise, the program advances from the step S14 to a step S15.

The step S15 sets the relays 53 and 531 to their on positions to activate the heating member 2 of the glow plug 1. After the step S15, the current execution cycle of the program segment ends and then the program returns to the main routine.

The step S16 sets the relays 53 and 531 to their off positions to deactivate the heating member 2 of the glow plug 1. After the step S16, the current execution cycle of the program segment ends and then the program returns to the main routine.

Figure 9:
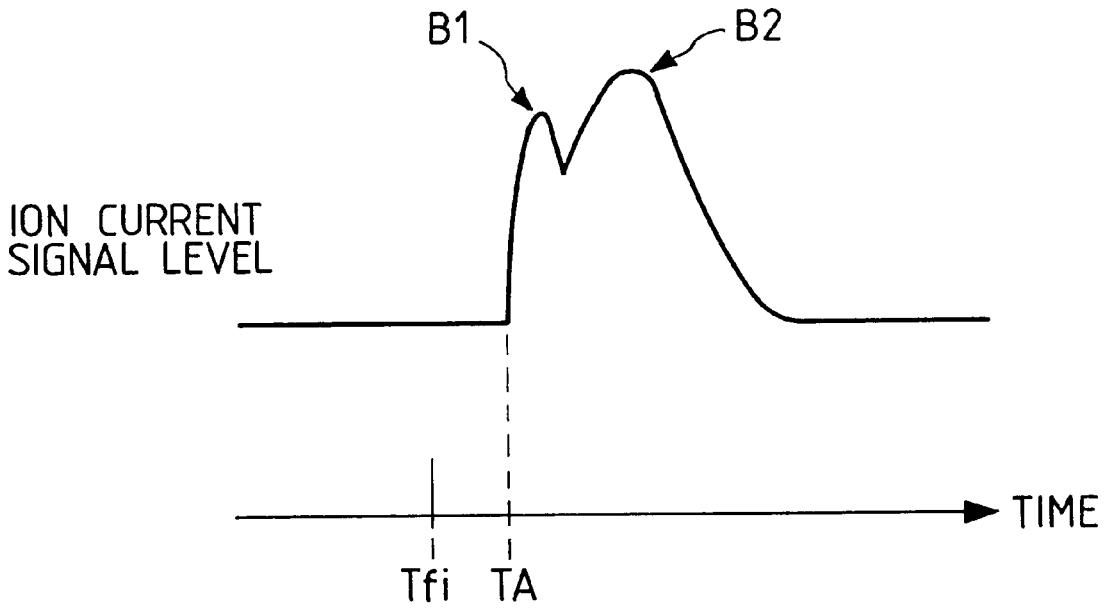
FIG. 9 is a time-domain diagram of an ion-current signal level.

FIG. 9 shows the waveform of a voltage signal representative of an ion current which occurs during operation of the engine. The voltage signal is, for example, the output signal of the potentiometer 522. The waveform of the voltage signal can be monitored by an oscilloscope.

With reference to FIG. 9, the signal level abruptly rises at a moment TA immediately after a moment Tfi of fuel injection which corresponds to a compression TDC (a compression top dead center) in crank angle. The moment TA is a time position of start of the burning of an air-fuel mixture, that is, a time position of ignition of the air-fuel mixture. The signal level peaks at two different time points following the moment TA. The first peak B1 is caused by the generation of ions in the spreading flame during an initial stage of the burning of the air-fuel mixture. The second peak B2 is caused by re-ionization due to a rise in the combustion-chamber pressure during intermediate and later stages of the burning of the air-fuel mixture.

The ECU 52 is programmed to implement the following processes. The ECU 52 detects an actual ignition timing from the first peak B1 of the signal level. The ECU 52 controls a fuel injection timing in response to the detected ignition timing on a feedback control basis to move and maintain the actual ignition timing toward and at a desired ignition timing (a target ignition timing). The ECU 52 detects the occurrence of abnormal burning or a misfire as burning conditions from the second peak B2 of the signal level. The ECU 52 controls fuel injection in response to the detected burning conditions. In this way, the ECU 52 uses information of the ion current in the fuel injection control. Accordingly, it is possible to finely control operating conditions of the engine.

In the glow plug 1, the support member 11 contains the heating member 2, the lead wires 21 and 22, and the ion sensing electrode 3. The support member 11, the heating member 2, the lead wires 21 and 22, and the ion sensing electrode 3 are combined into a single unit. The glow plug 1 can be used in both a heating process and an ion-current detecting process. The heating process employs the heating member 2 while the ion-current detecting process employs the ion sensing electrode 3. The glow plug 1 is relatively compact as a glow plug usable in both a heating process and an ion-current detecting process.

The tip of the main body 10, that is, the lower end of the main body 10 (the lower end of the support member 11), is hemispherical. The hemispherical shape enables a thermal shock to be effectively absorbed.

As previously indicated, the support member 11 uses ceramic which has an insulation resistance of about 20 MΩ or less at a temperature of 300° C. Thus, the support member 11 has a conductivity sufficient to conduct an ion current. In view of the sufficient conductivity of the support member 11, an ion current can be accurately detected via the ion sensing electrode 3 even when the ion sensing electrode 3 is buried in the support member 11 as shown in FIG. 1. Since the ion sensing electrode 3 is buried in the support member 11, it is possible to prevent the ion sensing electrode 3 from being exposed to a burning flame. Furthermore, it is possible to prevent the ion sensing electrode 3 from being corroded and damaged. Thus, the ion sensing electrode 3 can use inexpensive metal other than platinum, and the glow plug 1 can be low in price.

The heating member 2 and the lead wires 21 and 22 are provided in the support member 11. Thus, it is possible to prevent the heating member 2 and the lead wires 21 and 22 from being corroded or oxidized by burning gases. Accordingly, the heating member 2 and the lead wires 21 and 22 are durable.

It should be noted that the voltage generated by the dc power supply 51 may differ from 500 V. The voltage generated by the dc power supply 51 may be equal to about 10 V.

Second Specific Embodiment

Samples E1, E2, E3, and E4 of the support member 11 in the first embodiment were made from different materials as follows. Regarding the sample E1, main ingredients were prepared which had 95% $Si_3N_4$ and 5% $TiB_2$ by weight. The $Si_3N_4$ ingredient was insulating ceramic. The $TiB_2$ ingredient was electrically conductive ceramic. As sintering assistants, $Y_2O_3$ and $Al_2O_3$ were added to the main ingredients by 10 weight-%. In addition, a composite binder was added thereto by 15 weight-%. The composite binder contained paraffin wax as a main component. The main ingredients and the added materials were mixed into a lump of ceramic powder. Molded members for the heating member 2 and the ion sensing electrode 3 were placed in the lump of ceramic powder. Then, the lump of ceramic powder was subjected to injection molding. The molding-resultant thing was subjected to pressure sintering for 60 minutes. Conditions of the pressure sintering were as follows. The applied pressure was equal to 500 kg/cm$^2$. The sintering temperature (the firing temperature) was equal to 1,800° C. As a result of the pressure sintering, the sample E1 was completed.

Regarding the sample E2, main ingredients were prepared which had 95% $Si_3N_4$ and 5% TiN by weight. The $Si_3N_4$ ingredient was insulating ceramic. The TiN ingredient was electrically conductive ceramic. As sintering assistants, $Y_2O_3$ and $Al_2O_3$ were added to the main ingredients by 10 weight-%. In addition, a composite binder was added thereto by 15 weight-%. The composite binder contained paraffin wax as a main component. The main ingredients and the added materials were mixed into a lump of ceramic powder. Molded members for the heating member 2 and the ion sensing electrode 3 were placed in the lump of ceramic powder. Then, the lump of ceramic powder was subjected to injection molding. The molding-resultant thing was subjected to pressure sintering for 60 minutes. Conditions of the pressure sintering were as follows. The applied pressure was equal to 500 kg/cm$^2$. The sintering temperature (the firing temperature) was equal to 1,800° C. As a result of the pressure sintering, the sample E2 was completed.

Regarding the sample E3, main ingredients were prepared which had 95% $Si_3N_4$ and 5% $MOSi_2$ by weight. The $Si_3N_4$ ingredient was insulating ceramic. The $MOSi_2$ ingredient was electrically conductive ceramic. As sintering assistants, $Y_2O_3$ and $Al_2O_3$ were added to the main ingredients by 10 weight-%. In addition, a composite binder was added thereto by 15 weight-%. The composite binder contained paraffin wax as a main component. The main ingredients and the added materials were mixed into a lump of ceramic powder. Molded members for the heating member 2 and the ion sensing electrode 3 were placed in the lump of ceramic powder. Then, the lump of ceramic powder was subjected to injection molding. The molding-resultant thing was subjected to pressure sintering for 60 minutes. Conditions of the pressure sintering were as follows. The applied pressure was equal to 500 kg/cm$^2$. The sintering temperature (the firing temperature) was equal to 1,800° C. As a result of the pressure sintering, the sample E3 was completed.

Regarding the sample E4, main ingredients were prepared which had 95% $Si_3N_4$ and 5% $Mo_2C$ by weight. The $Si_3N_4$ ingredient was insulating ceramic. The $Mo_2C$ ingredient was electrically conductive ceramic. As sintering assistants, $Y_2O_3$ and $Al_2O_3$ were added to the main ingredients by 10 weight-%. In addition, a composite binder was added thereto by 15 weight-%. The composite binder contained paraffin wax as a main component. The main ingredients and the added materials were mixed into a lump of ceramic powder. Molded members for the heating member 2 and the ion sensing electrode 3 were placed in the lump of ceramic powder. Then, the lump of ceramic powder was subjected to injection molding. The molding-resultant thing was subjected to pressure sintering for 60 minutes. Conditions of the pressure sintering were as follows. The applied pressure was equal to 500 kg/cm$^2$. The sintering temperature (the firing temperature) was equal to 1,800° C. As a result of the pressure sintering, the sample E4 was completed.

A comparative support member C1 was made as follows. A main ingredient was prepared which had 100% $Si_3N_4$. Thus, the main ingredient did not contain electrically conductive ceramic. As sintering assistants, $Y_2O_3$ and $Al_2O_3$ were added to the main ingredient by 10 weight-%. In addition, a composite binder was added thereto by 15 weight-%. The composite binder contained paraffin wax as a main component. The main ingredient and the added materials were mixed into a lump of ceramic powder. Molded members for the heating member 2 and the ion sensing electrode 3 were placed in the lump of ceramic powder. Then, the lump of ceramic powder was subjected to injection molding. The molding-resultant thing was subjected to pressure sintering for 60 minutes. Conditions of the pressure sintering were as follows. The applied pressure was equal to 500 kg/cm$^2$. The sintering temperature (the firing temperature) was equal to 1,800° C. As a result of the pressure sintering, the comparative support member C1 was completed.

Regarding each of the samples E1, E2, E3, and E4 of the support member 11, the insulation resistance of the region between an outer surface thereof and the ion sensing electrode 3 was measured at varying temperatures. Also, regarding the comparative support member C1, the insulation resistance of the region between an outer surface thereof and the ion sensing electrode 3 was measured at varying temperatures. In FIG. 6, the line denoted by "E1" represents the results of the measurement which correspond to the relation between the insulation resistance of the sample E1 and the ambient temperature. In addition, the line denoted by "E2" represents the results of the measurement which correspond to the relation between the insulation resistance of the sample E2 and the ambient temperature. Also, the line denoted by "E3" represents the results of the measurement which correspond to the relation between the insulation resistance of the sample E3 and the ambient temperature. In addition, the line denoted by "E4" represents the results of the measurement which correspond to the relation between the insulation resistance of the sample E4 and the ambient temperature. Furthermore, the line denoted by "C1" represents the results of the measurement which correspond to the relation between the insulation resistance of the comparative support member C1 and the ambient temperature. As shown in FIG. 6, the insulation resistance of the sample E1 was equal to about 20 MΩ or less at a temperature of 300° C. The insulation resistances of the samples E2, E3, and E4 were equal to about 50 MΩ or less at a temperature of 300° C. On the other hand, the insulation resistance of the comparative support member C1 was equal to about 500 MΩ.

Glow plugs were made which used the samples E1, E2, E3, and E4 of the support member 11, respectively. A glow plug was made which used the comparative support member C1. A test was given as to whether each of these glow plugs could successfully detect an ion current. It was found that the glow plugs which used the samples E1, E2, E3, and E4 of the support member 11 could successfully detect ion currents. On the other hand, it was found that the glow plug which used the comparative support member C1 failed to detect an ion current.

In connection with each of the samples E1, E2, E3, and E4 of the support member 11, as the weight percentage of the addition of the electrically conductive ceramic is increased from 5%, the insulation resistance drops.

Third Specific Embodiment

Figure 10:
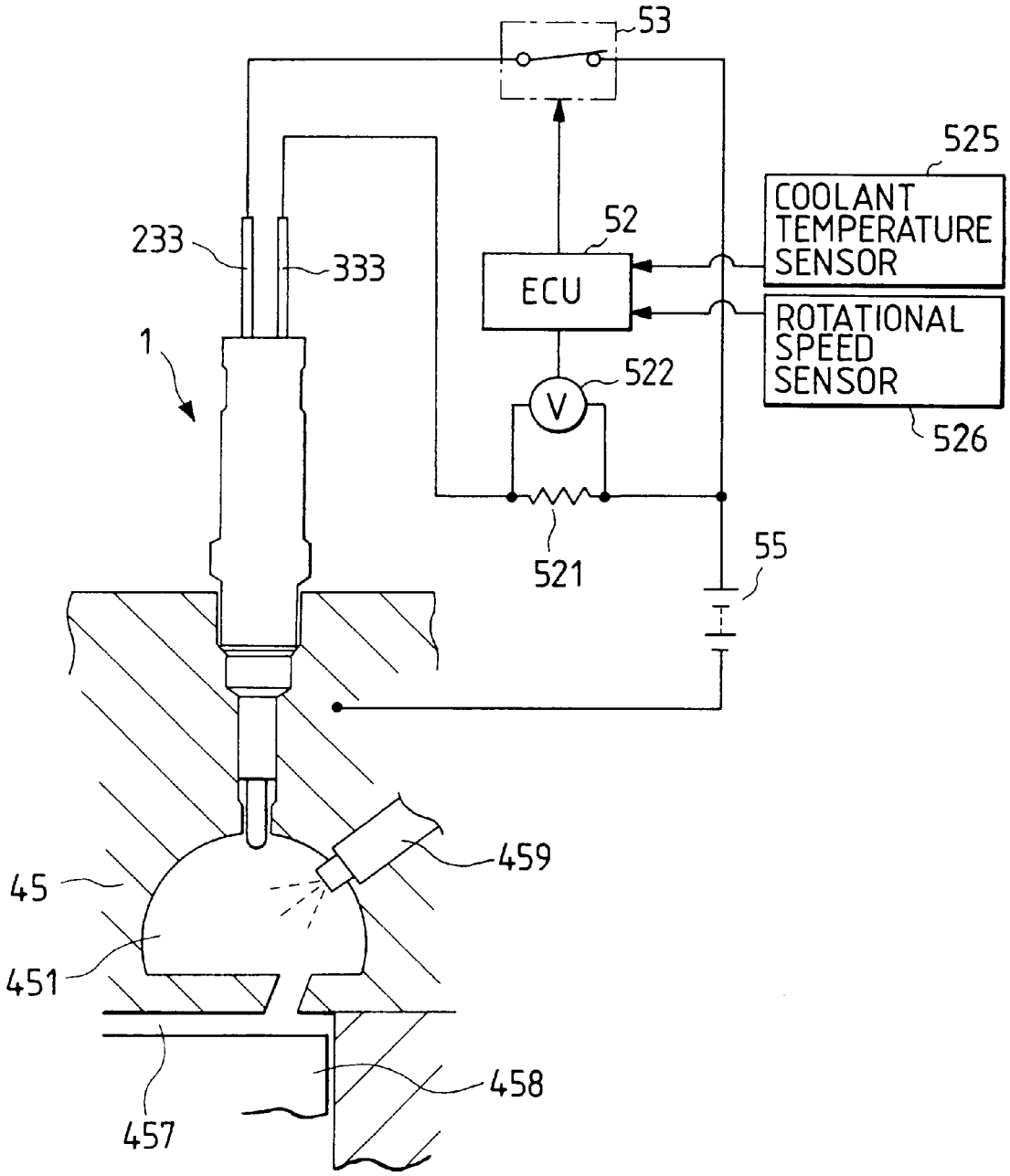
FIG. 10 is a diagram of a glow plug and a drive circuit for the glow plug according to a third specific embodiment of this invention.

FIG. 10 shows a third embodiment of this invention which is similar to the embodiment of FIG. 7 except for design changes indicated hereinafter. The embodiment of FIG. 10 includes a battery 55 instead of the dc power supply 51 (see FIG. 7). The battery 54 and the relay 531 (see FIG. 7) are omitted from the embodiment of FIG. 10. In the embodiment of FIG. 10, the lead wire 233 is electrically connected to the positive terminal of the battery 55 via the relay 53.

It is preferable to provide the potentiometer 522 with an amplifier.

The embodiment of FIG. 10 is advantageous since the electric-circuit structure thereof is relatively simple.

Fourth Specific Embodiment

Figure 11:
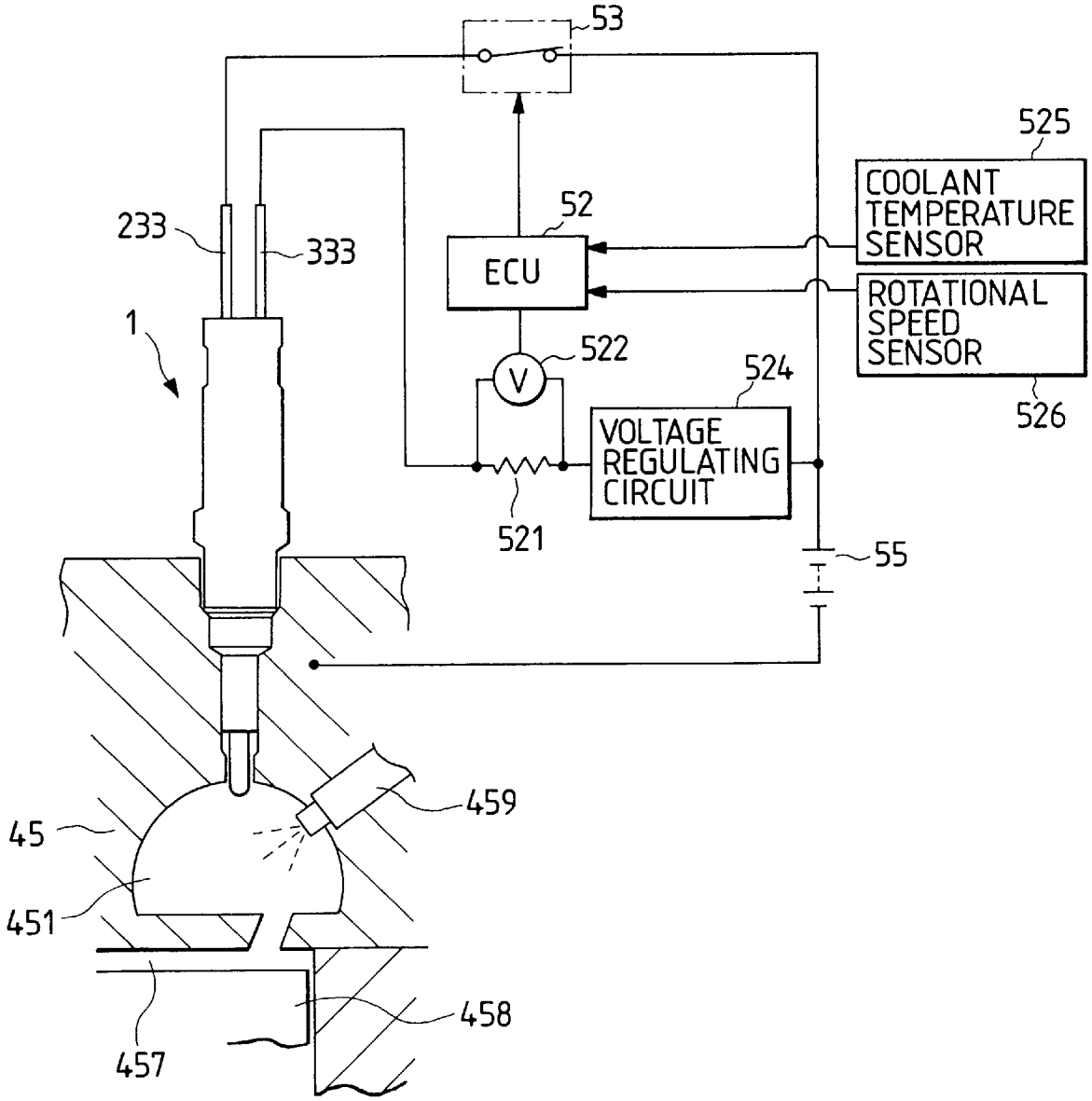
FIG. 11 is a diagram of a glow plug and a drive circuit for the glow plug according to a fourth specific embodiment of this invention.

FIG. 11 shows a fourth embodiment of this invention which is similar to the embodiment of FIG. 10 except for an additional design indicated hereinafter. The embodiment of FIG. 11 includes a voltage regulating circuit 524 connected between the battery 55 and the fixed resistor 521. The voltage regulating circuit 524 stabilizes the voltage applied to the ion sensing electrode within the glow plug 1. The stabilization of the applied voltage provides stable detection of the ion current.

Fifth Specific Embodiment

Figure 12:
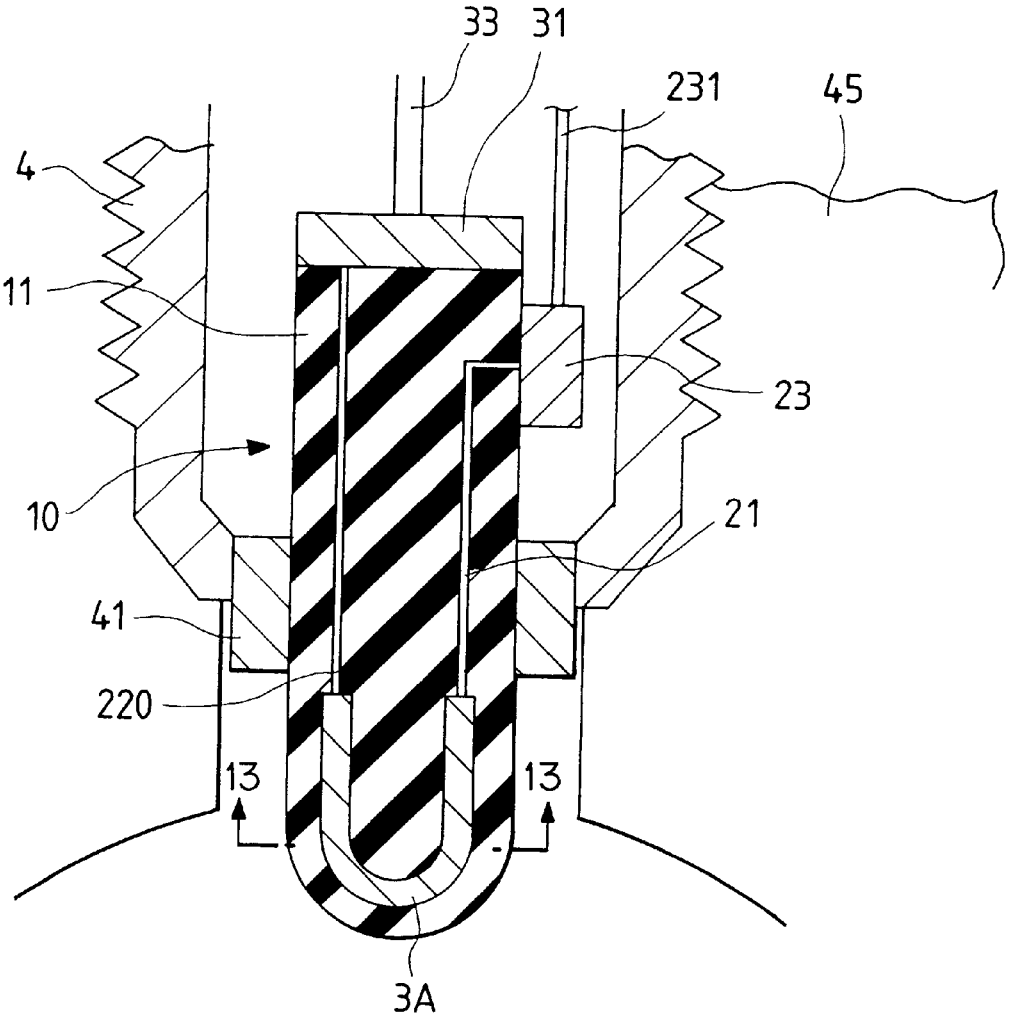
FIG. 12 is a sectional view of a portion of a glow plug according to a fifth specific embodiment of this invention.
Figure 13:
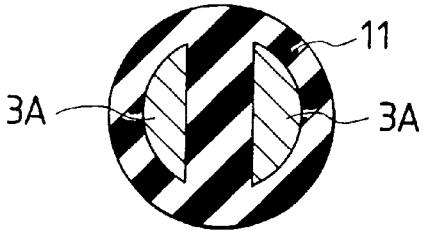
FIG. 13 is a sectional view taken along the line B—B in FIG. 12.

FIGS. 12 and 13 show a fifth embodiment of this invention which is similar to the embodiment of FIGS. 1 and 2 except for design changes indicated hereinafter. As will be made clear later, in the embodiment of FIGS. 12 and 13, the heating member 2 (see FIGS. 1 and 2) and the ion sensing electrode 3 (see FIGS. 1 and 2) are formed by a single member.

With reference to FIGS. 12 and 13, a main body 10 of a glow plug includes a support member 11, a multiple-purpose electrode 3A, and a pair of lead wires 21 and 220. The multiple-purpose electrode 3A has a shape of the letter "U". The multiple-purpose electrode 3A can serve as an ion sensing electrode and also a heating member. The multiple-purpose electrode 3A is provided within the support member 11. The lead wires 21 and 220 extend in the support member 11. A first end of the lead wire 21 is electrically connected to a first end of the multiple-purpose electrode 3A. A second end of the lead wire 21 reaches a side surface of the support member 11. The second end of the lead wire 21 is electrically connected to an electrically conductive terminal 23 provided on the side surface of the main body 10. The lead wire 21 is electrically connected to a lead wire 231 via the terminal 23. A first end of the lead wire 220 is electrically connected to a second end of the multiple-purpose electrode 3A. A second end of the lead wire 220 is electrically connected to an electrically conductive terminal 31 provided on a top end of the support member 11. The lead wire 220 is electrically connected to a lead wire 33 via the terminal 31.

A switch (not shown) selectively connects the multiple-purpose electrode 3A to either a first circuit (not shown) or a second circuit (not shown). This switch is controlled by an ECU 52 (see FIG. 7) so that one of the first and second circuits will be selected. The first circuit serves to operate the multiple-purpose electrode 3A as a heating member. The second circuit serves to operate the multiple-purpose electrode 3A as an ion sensing electrode.

The multiple-purpose electrode 3A enables a simple structure of the glow plug. The multiple-purpose electrode 3A has a large effective area related to an ion sensing process. The large effective area results in a high accuracy of detection of an ion current.

What is claimed is:

1. A glow plug comprising:

a housing;

a main body at least partially disposed in the housing and supported with respect to the housing;

a support member included in the main body;

a heating member provided in the support member;

a pair of lead wires electrically connected to two ends of the heating member respectively and extending out of the support member; and an ion sensing electrode provided in the support member for detecting a condition of ionization in a flame;

wherein the ion sensing electrode is buried in the support member to be prevented from being exposed to the flame.

2. A glow plug as set forth in claim 1, wherein an insulation resistance of a region of the support member between an outer surface of the support member and the ion sensing electrode is equal to 50 MΩ or less at a temperature of 300° C.

3. A glow plug as set forth in claim 1, wherein the support member is made from a mixture of insulating ceramic, electrically conductive ceramic, and a sintering assistant, wherein the insulating ceramic includes silicon nitride, wherein the electrically conductive ceramic includes at least one of metal nitride, metal boride, metal carbide, and metal silicide, and wherein the sintering assistant includes aluminum oxide and at least one of rare-earth element oxides.

4. A glow plug as set forth in claim 1, wherein the heating member and the ion sensing electrode are formed by a single member.

5. A glow plug comprising:

a support member;

a heating member provided in the support member; and an electrode for sensing an ion current, the electrode having a sensing portion which is buried in the support member, such that said electrode is protected by the support member.

* * * * *